US012239230B2

(12) United States Patent
Grady et al.

(10) Patent No.: US 12,239,230 B2
(45) Date of Patent: Mar. 4, 2025

(54) ADJUSTABLE FIRMNESS MATTRESS ASSEMBLIES

(71) Applicant: DREAMWELL, LTD., Doraville, GA (US)

(72) Inventors: Alex Grady, Atlanta, GA (US); Victor Prince, Chamblee, GA (US)

(73) Assignee: DREAMWELL, LTD., Doraville, GA (US)

( * ) Notice: Subject to any disclaimer, the term of this patent is extended or adjusted under 35 U.S.C. 154(b) by 0 days.

(21) Appl. No.: 17/709,969

(22) Filed: Mar. 31, 2022

(65) Prior Publication Data

US 2023/0309704 A1 Oct. 5, 2023

(51) Int. Cl.

| | |
|---|---|
| ***A47C 23/28*** | (2006.01) |
| ***A47C 23/16*** | (2006.01) |
| ***A47C 23/18*** | (2006.01) |
| ***A47C 23/20*** | (2006.01) |
| ***A47C 23/22*** | (2006.01) |
| ***A47C 23/24*** | (2006.01) |
| ***A47C 23/26*** | (2006.01) |

(52) U.S. Cl.

CPC ..... *A47C 23/28* (2013.01); *A47C 23/24* (2013.01); *A47C 23/26* (2013.01); *A47C 23/16* (2013.01); *A47C 23/18* (2013.01); *A47C 23/20* (2013.01); *A47C 23/22* (2013.01)

(58) Field of Classification Search

CPC ..... A47C 23/28; A47C 23/24; A47C 23/26; A47C 23/22; A47C 23/20; A47C 23/16; A47C 23/18; A47C 31/02; A47C 31/023; A47C 31/04; A47C 31/06; A47C 31/23; Y10T 24/3771; Y10T 24/3787

See application file for complete search history.

(56) References Cited

U.S. PATENT DOCUMENTS

| | | | | |
|---|---|---|---|---|
| 4,263,683 | A * | 4/1981 | Knoke | A47C 19/04 5/915 |
| 4,807,314 | A * | 2/1989 | Fry | A45F 3/22 5/118 |
| 7,467,426 | B1 * | 12/2008 | Jarmon | A47C 23/18 5/88.1 |
| 8,813,279 | B2 * | 8/2014 | Saunders | A47C 27/15 5/200.1 |
| 2004/0221390 | A1 * | 11/2004 | Frey | A47C 23/28 5/613 |
| 2010/0287707 | A1 * | 11/2010 | Beard | A47C 27/081 5/706 |
| 2013/0298335 | A1 * | 11/2013 | Abadi | A47C 31/105 5/724 |

FOREIGN PATENT DOCUMENTS

| | | | | |
|---|---|---|---|---|
| DE | 102018130111 | A1 * | 5/2020 | |
| GB | 2419523 | A * | 5/2006 | A01K 1/0353 |

* cited by examiner

*Primary Examiner* — David R Hare
*Assistant Examiner* — Deborah Talitha Gedeon
(74) *Attorney, Agent, or Firm* — CANTOR COLBURN LLP

(57) ABSTRACT

A mattress assembly generally includes a tension adjustable and stretchable fabric panel coupled to a rail system. Axial tension of the stretchable fabric panel can be adjusted to change a firmness property associated with the mattress assembly.

5 Claims, 2 Drawing Sheets

ADJUSTABLE FIRMNESS MATTRESS ASSEMBLIES

BACKGROUND

The present disclosure generally relates to mattress assemblies, and more particularly, to mattress assemblies including a tension adjustable and stretchable fabric panel that can be configured to adjust firmness in one or more zones of the mattress assemblies.

Mattress assemblies often exhibit uneven pressure distribution and spinal misalignment depending on the quality of mattress construction. Relief can often be addressed with different foams and/or coil systems used in the mattress construction, which can add manufacturing complexity and significant cost increases. Still, even with these types of modifications, relief is generalized and somewhat optimized for all consumers of the mattress assemblies. Personalization is generally not provided, and for most constructions, not economically practical to the bedding manufacturer. Moreover, existing mattress assemblies do a poor job in zoning for different regions of the body. Compression can be a culprit of pain points being created while tension strives to distribute the load.

BRIEF SUMMARY

Disclosed herein a mattress assemblies.

In one or e other embodiments, a mattress assembly includes a rail assembly including first and second side rails spanning a length of the mattress assembly and first and second transverse rails spanning a width of the mattress assembly attached at terminal ends to corresponding terminal ends of the first and second rails to define a perimeter of the rail assembly; and an adjustable rail extending between the first and second side rails or the first and second transverse rails, wherein the first and second side rails and the first and second transverse rail are fixedly positioned relative to one another, and the adjustable rail is movable relative to the first and second side rails or the first and second transverse rails. The mattress assembly further includes a stretchable fabric panel, wherein a portion of the stretchable fabric panel is attached to the adjustable rail and it portion is attached to an opposing one of the fixedly positioned rails, wherein a tension of the stretchable fabric panel is configured to be axially adjusted upon movement of the adjustable rail.

In still one or more other aspects, the stretchable fabric panel includes a ratchet mechanism, wherein the stretchable fabric panel is configured to be axially adjusted relative to the rail assembly. The stretchable fabric can include elastomeric fibers that can be adjustably coupled to, the rail assembly with a ratchet and lace system.

The disclosure may be understood more readily by reference to the following detailed description of the various features of the disclosure and the examples included therein.

BRIEF DESCRIPTION OF FIGURES

Referring now to the figures wherein the like elements are numbered alike.

DETAILED DESCRIPTION

Figure 1:
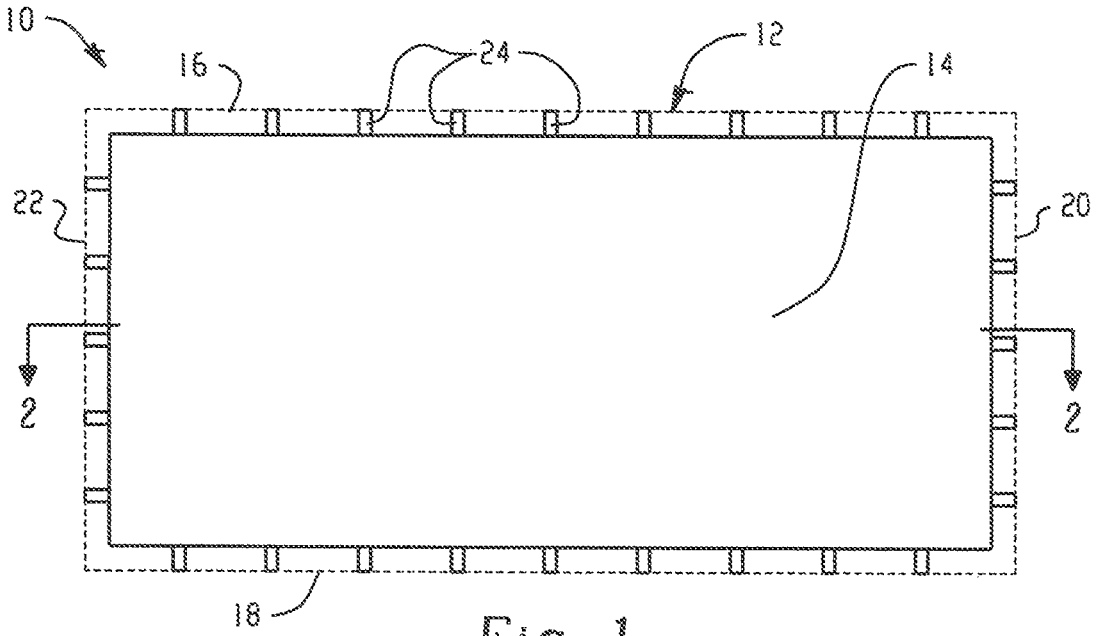
FIG. 1 illustrates a top down view of a mattress assembly including a tension adjustable and stretchable fabric in accordance with one or more embodiments of the present disclosure.

Disclosed herein are mattress assemblies including a tension adjustable and stretchable fabric panel spanning one or more surfaces of the mattress assemblies. The stretchable fabric panel is formed of elastomeric fibers and can be axially stretched transverse to a rail assembly system to provide the panel surface with adjustable tension levels so as to provide adjustable firmness. In one or more embodiments, the stretchable fabric panel and/or rail system can be configured to provide multiple zones, wherein each zone can include tension adjustment, which generally translates to different firmness levels. In this manner, the firmness level can be personally adjusted based on the end user's inputs.

In one or more embodiments, the tension adjustable and stretchable fabric panel is attached to a rail assembly. The rail assembly is generally rigid and defines a perimeter of the mattress assembly, wherein the stretchable fabric material is adjustably attached to the rail assembly about the perimeter to provide axial tension adjustment. In one or more embodiments, the rail assembly can include additional support rails spanning lengthwise and/or widthwise across the perimeter to define zones, wherein separate panels of the stretchable fabric material can be fastened to the rails at different axial tensions to provide multiple zones with different firmness levels. The stretchable fabric panel would be connected to several support beams to isolate different regional firmness responses. Additionally, the amount of stretch provided by the fabric material can be dialed in based on the weave and threading of material in one region compared to another region. Optionally, a foam layer can be provided underneath the stretchable fabric material to provide additional support.

In one or more other embodiments, the rail assembly can include one or more position adjustable rails. For example, one or more of the support rails can be configured to be movable relative to the fixedly positioned perimeter rails. In this manner, a portion of the stretchable fabric material can be attached to the position adjustable rail and another portion attached to a fixedly positioned perimeter rail of the rail assembly. Axial tension adjustment can be made by moving the adjustable rail to location providing a desired tension in the fabric. The at least one position adjustable rail can be moved relative to the fixedly positioned perimeter rail to change the axial tension of the stretchable fabric material to provide a desired firmness level to the mattress assembly. In embodiments including multiple position adjustable rails, the presence thereof can be used to provide different firmness levels across the fabric panel such as may be desirable for different zones associated with different regions of a prone body thereon. For example, the fabric panel can be configured to have a low firmness level at about a foot region of the mattress assembly and a higher firmness load at about a torso region of the end user.

In one or more other embodiments, the mattress assembly includes a tensioning mechanism to adjust axial tension of the stretchable fabric material. By way of example, the fabric material can be attached to the rectangular shaped perimeter metal rail assembly as generally described above using a lacing system, which can be coupled to a ratcheting mechanism to increase or decrease tension within the lacing, which, in turn, changes the axial tension of the fabric panel. In this manner, the firmness of the fabric panel can be adjusted with the ratcheting mechanism by the end user to provide a desired firmness level. Exemplary ratchet and lace systems that can be readily modified to adjust fabric tension are disclosed in U.S. Pat. Nos. 7,950,112 and 7,954,204 to Boa Technology, Inc., incorporated herein by reference in its entirety. In one or more embodiments, the ratcheting component is motorized such as is disclosed in U.S. Pat. No. 10,575,591 to Boa Technology, Inc., incorporated herein by reference in its entirety.

Conventional techniques related to manufacturing processes such as the use of stitching, application of adhesives assembly steps, and the like are well known and so, in the interest of brevity, many conventional steps will only be mentioned briefly herein or will be omitted entirely without providing the well-known process details.

For the purposes of the description hereinafter, the terms "upper", "lower", "top", "bottom", "left," and "right," and derivatives thereof shall relate to the described structures, as they are oriented in the drawing figures. The same numbers in the various figures can refer to the same structural component or part thereof. Additionally, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

Spatially relative terms, e.g., "beneath," "below," "lower," "above," "upper," and the like, can be used herein for ease of description to describe one element or feature's relationship to another element(s) or feature(s) as illustrated in the figures.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the term "about" modifying the quantity of an ingredient, component, or reactant of the invention employed refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like.

It will also be understood that when an element, such as a layer, region, or substrate is referred to as being "on" or "over" another element, it can be directly on the other element or intervening elements can also be present. In contrast, when an element is referred to as being "directly on" or "directly over" another element, there are no intervening elements present, and the element is in contact with another element.

Figure 2:
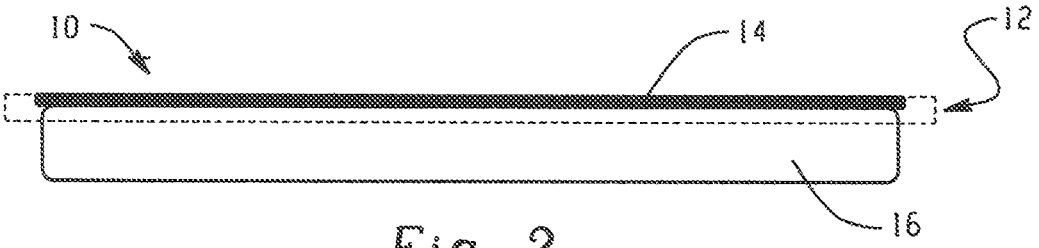
FIG. 2 illustrates an elevational view of the mattress assembly taken along lines 2-2 of FIG. 1 in accordance with one or more embodiments of the present disclosure.

Turning now to FIGS. 1 and 2, there is depicted a top-down and cross sectional views of a mattress assembly 10 including a fixed perimeter rail assembly 12 and a fabric panel 14 formed of a stretchable fabric material attached to the rails at a predetermined axial tension based on the stretch characteristics of the stretchable fabric material. The perimeter rail assembly 12 includes first and second side rails 16, 18 generally defining a length of the mattress assembly and transverse rails 20, 22 attached at respective terminal ends of the side rails 16, 18 generally defining a width of the mattress assembly. Securing the stretchable fabric material to the perimeter rails is not intended to be limited. In one embodiment, loops 24 of the fabric material is secured to rails. The loops can be loosened or tightened to provide the stretchable fabric panel with a desired axial tension. Although loops are generally shown, any adjustable fastener can be used to fasten the panel to the rails. The adjustable fastener can be integrated into the fabric panel or can be a discrete member. The rail assembly can be configured to accept the discrete member and permit tension adjustment.

The fixed perimeter rail assembly 12 is generally rectangular shaped having dimensions approximating the width and length of the mattress assembly. For example, the perimeter rail assembly can be of a mattress size such as a twin, queen, oversized queen, king, or California king sized mattress, as well as custom or non-standard sizes constructed to accommodate a particular user or a particular room.

In other configurations, abutting perimeter rail assemblies (not shown) can be coupled to one another to define the overall mattress length and width dimensions.

FIG. 2 illustrates an optional layer 26, which can be adhesively attached to the fabric material to provide additional support. Layer 26 can be a foam layer, a coil layer, one or more air bladders, a side rail assembly extending about the sides of the mattress core, combinations thereof, and the like. A side rail assembly having increased firmness may be provided about the sides of layer 26. The thickness of layer 26 can vary and is generally from about ½ inch in thickness to about 14 inches or less in thickness, although greater thickness can be utilized.

The coil layer, when present, generally includes coil springs that are not intended to be limited to any specific type or shape. The coil springs can be single stranded or multi-stranded, pocketed or not pocketed, asymmetric or symmetric, and the like. It will be appreciated that the pocketed coils may be manufactured in single pocket coils or strings of pocket coils, either of which may be suitably employed with the mattresses described herein. The attachment between coil springs may be any suitable attachment. For example, pocket coils are commonly attached to one another using hot-melt adhesive applied to abutting surfaces during construction.

Suitable foams for the different layers that include foam, include but are not limited to, polyurethane foams, latex foams including natural, blended and synthetic latex foams; polystyrene foams; polyethylene foams, polypropylene foam, polyether-polyurethane foams, and the like. Likewise, the foam can be selected to be viscoelastic or non-viscoelastic foams. Some viscoelastic materials are also temperature sensitive, thereby also enabling the foam layer to change hardness/firmness based in part upon the temperature of the supported part. Unless otherwise noted, any of these foams may be open celled or closed cell or a hybrid structure of open cell and closed cell. Likewise, the foams can be reticulated, partially reticulated or non-reticulated foams. The term reticulation generally refers to removal of cell membranes to create an open cell structure that is open to air and moisture flow. Still further, the foams may be gel infused in some embodiments. The different layers can be formed of the same material configured with different properties or different materials.

Figure 3:
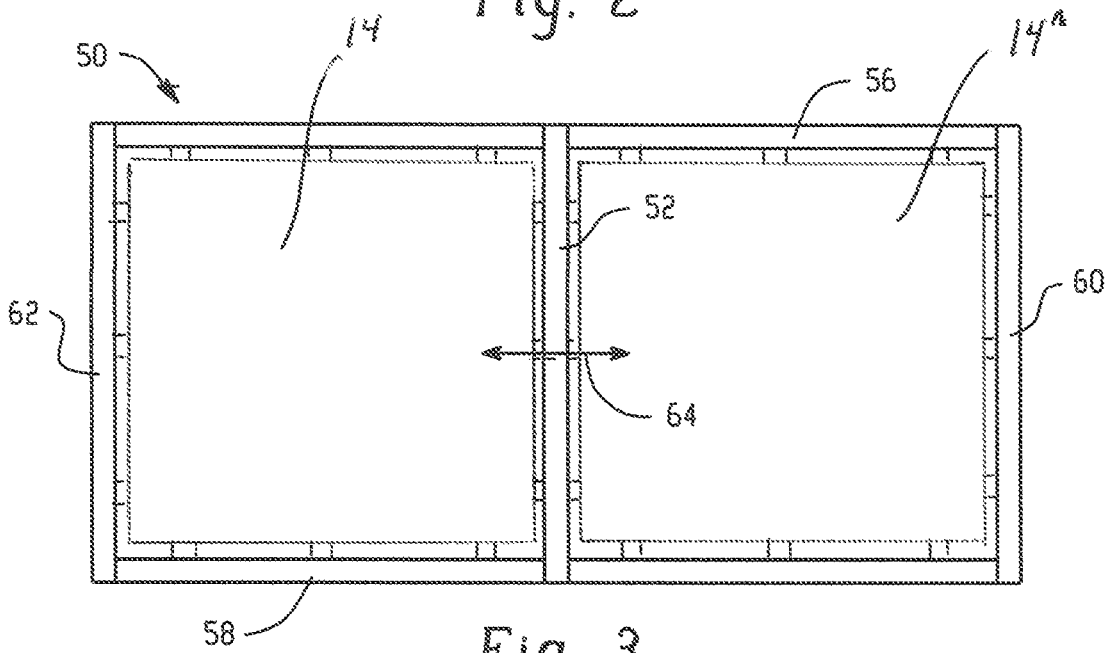
FIG. 3 illustrates top-down view of an adjustable rail assembly for the tension adjustable and stretchable fabric in accordance with one or more embodiments of the present disclosure.

As shown in FIG. 3, an adjustable rail system 50 for adjusting tension of a stretchable fabric panel in mattress assembly is depicted and includes one or more adjustable rails 52, one of which is shown, that is adjustable relative to stationary perimeter rails 56, 58, 60, and 62. The adjustable rail 52 can be attached to opposing rails 56, 58 or 60, 62 at different locations in a known manner, wherein a portion of the stretchable fabric panel is attached to the non-adjustable rail 52 and an opposing portion of the stretchable fabric panel attached to the adjustable rail 52. Axial tension of one or mom stretchable fabric panels can be readily adjusted by movement of the adjustable rail 52 as indicated by arrow 64 to provide a desired firmness level within different regions. In this manner, the rail and stretch fabric system with strategically placed beams can be used to provide to zone support for different regions of the body. The rail is robust and rigid. The stretch fabric connects along the edges of the bed. The fabric has the potential to be zoned as well based on the weaving of the knit to create different firmness across the mattress. For additional support, components (i.e., foam) can be placed underneath the fabric inside the railing to provide additional support and comfort to end users.

Figure 4:
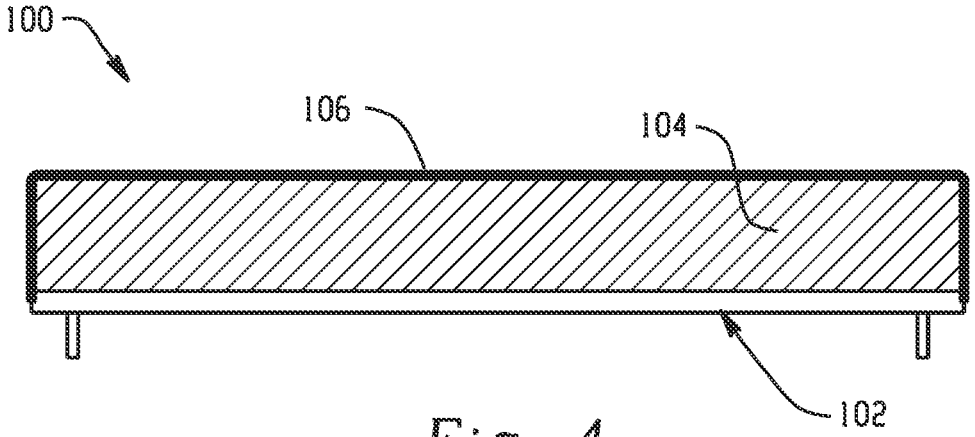
FIG. 4 pictorially illustrates an elevational view of a mattress assembly including a tension adjustable and stretchable fabric in accordance with one or more embodiments of the present disclosure.

FIG. 4 illustrates a mattress assembly 100 including a rail system 102 such as previously described. The rail system 102 can be used to define a rigid platform upon which a cushioned support 104 can be disposed. A stretchable fabric panel 106 overlies the cushioned support 104 and is attached to perimeter rails defining of the rail system 102. Tension of the fabric panel can be adjusted by tightening or loosening the fabric panel at the point of attachment to the rail system.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly comprising:

a rail assembly comprising first and second side rails spanning a length of the mattress assembly and first and second transverse rails spanning a width of the mattress assembly attached at terminal ends to corresponding terminal ends of the first and second rails to define a perimeter of the rail assembly; and a single adjustable rail extending between and adjustably coupled to the first and second side rails or the first and second transverse rails, wherein the first and second side rails and the first and second transverse rails are fixedly positioned relative to one another, and the single adjustable rail is coupled to and movable relative to the first and second side rails or the first and second transverse rails; and a stretchable fabric panel, wherein a portion of the stretchable fabric is attached to the single adjustable rail and a portion is attached to an opposing one of the fixedly positioned rails, wherein a tension of the stretchable fabric panel is configured to be axially adjusted upon movement of the single adjustable rail, and wherein the stretchable fabric panel has length and width dimensions less than the perimeter length and width dimensions corresponding to the rail assembly.

2. The mattress assembly of claim 1, wherein the stretchable fabric comprises elastomeric fibers.

3. The mattress assembly of claim 1, wherein the mattress assembly comprises multiple stretchable fabric panels coupled to the fixedly positioned rails and the single adjustable rail and arranged in zones, wherein the stretchable fabric panel in each zone has a different axial tension.

4. The mattress assembly of claim 1, wherein the tension is adjusted via a ratchet mechanism.

5. A mattress assembly comprising: a rigid planar support coupled to a rail assembly, the rail assembly comprising fixedly positioned first and second side rails spanning a length of the mattress assembly and fixedly positioned first and second transverse rails spanning a width of the mattress assembly attached at terminal ends to corresponding terminal ends of the first and second rails to define a perimeter of the rail assembly, a cushion support on the rigid planar support, and a stretchable fabric panel overlying the cushion support and attached to fixedly positioned first and second side rails and the fixedly positioned first and second transverse rails defining the rail assembly, wherein tension of the stretchable fabric panel can be adjusted at points of attachments to the rail assembly and configured to change a firmness property to the stretchable fabric panel, and wherein the stretchable fabric panel has length and width dimensions less than the perimeter length and width dimensions corresponding to the rail assembly.

* * * * *